United States Patent [19]

Macmillan

[11] 4,069,025

[45] Jan. 17, 1978

[54] BLAST IMPELLOR WHEELS

[75] Inventor: William Robertson Macmillan, Brooklands, England

[73] Assignee: Tilghman Wheelabrator Limited, Broadheath, England

[21] Appl. No.: 701,924

[22] Filed: July 1, 1976

[30] Foreign Application Priority Data

Oct. 24, 1975 United Kingdom ..... 43721/75

[51] Int. Cl.[2] ..... B24C 3/00

[52] U.S. Cl. ..... 51/434; 51/435

[58] Field of Search ..... 51/9, 434, 435; 241/275

[56] References Cited

U.S. PATENT DOCUMENTS

| | | | |
|---|---|---|---|
| 3,444,651 | 5/1969 | Geissler | 51/9 |
| 3,521,406 | 7/1970 | Carpenter | 51/9 |
| 3,683,556 | 8/1972 | Leliaert | 51/9 |

*Primary Examiner*—Donald G. Kelly

*Attorney, Agent, or Firm*—Sughrue, Rothwell, Mion, Zinn and Macpeak

[57] ABSTRACT

A blade for use in a blast impellor wheel for use in cleaning castings has both faces identical and symmetrical about its longitudinal axis so that both faces can be used as abrasive throwing faces. The blast impellor wheel comprises two interconnected parallel side plates each of which has a central opening. Opposed pairs of slots are provided in the inner faces of the side plates and these slots are transversely stepped so that protruberances on the side of a blade can abut against the ledges so formed.

11 Claims, 6 Drawing Figures

BLAST IMPELLOR WHEELS

The present invention relates to throwing blades for use in a blast impellor wheel, and to a blast impellor wheel incorporating the blades.

Conventionally, the throwing blades of a blast impellor wheel are each made with two different faces, namely a throwing face down which abrasive slides or travels and a back face against which most locking or retaining devices act to hold the blade inside the side plates of the wheel. Some retaining devices operate against the sides of the blade, but, however they are retained, the form of the known throwing blades only allows one face to be used as a throwing face. Hence, the impellor wheel is suitable for throwing abrasive in one direction of rotation only and this has led to the use of right hand and left hand wheels.

It is an object of the present invention to remove the need for right and left hand wheels so that by reversing the direction of rotation of the wheel the abrasive will be thrown in the opposite direction without any other change having to be made.

According to a first aspect of the present invention, there is provided a blade, for use in a blast impellor wheel, in which the faces of the blade are identical and in which each face is symmetrical about a longitudinal axis, both faces being able to be used as abrasive throwing faces.

Preferably, the faces of the blade are smooth and parallel at one end of the blade and, at the other end of the blade, are smooth but curve inwards towards each other.

Preferably also, the side edges of the faces of the blade are radiussed to merge with side flanges of the blade.

Preferably also, each blade has at its side edges protuberances for abutting against the ends of slots in the side plates of the wheel for retention purposes.

According to a second aspect of the present invention, there is provided a blast impellor wheel comprising two interconnected parallel side plates and at least one blade, according to the first aspect of the present invention, the side plates each having a central opening and opposed pairs of slots provided in the inner faces of the side plates, which slots are transversely stepped to provided ledges against which the protuberances on the sides of a blade abut.

According to a further aspect of the present invention there is provided a method of assembling a blast impellor wheel, according to the second aspect of the present invention, comprising the step of inserting at least one blade between the side plates through one of the central openings until the protuberances on the sides of the blade each abut the ledge of the slot in one of the side plates.

The present invention will now be described by way of example with reference to the accompanying drawings, in which.

Figures 1, 2, 3, 4, 5:
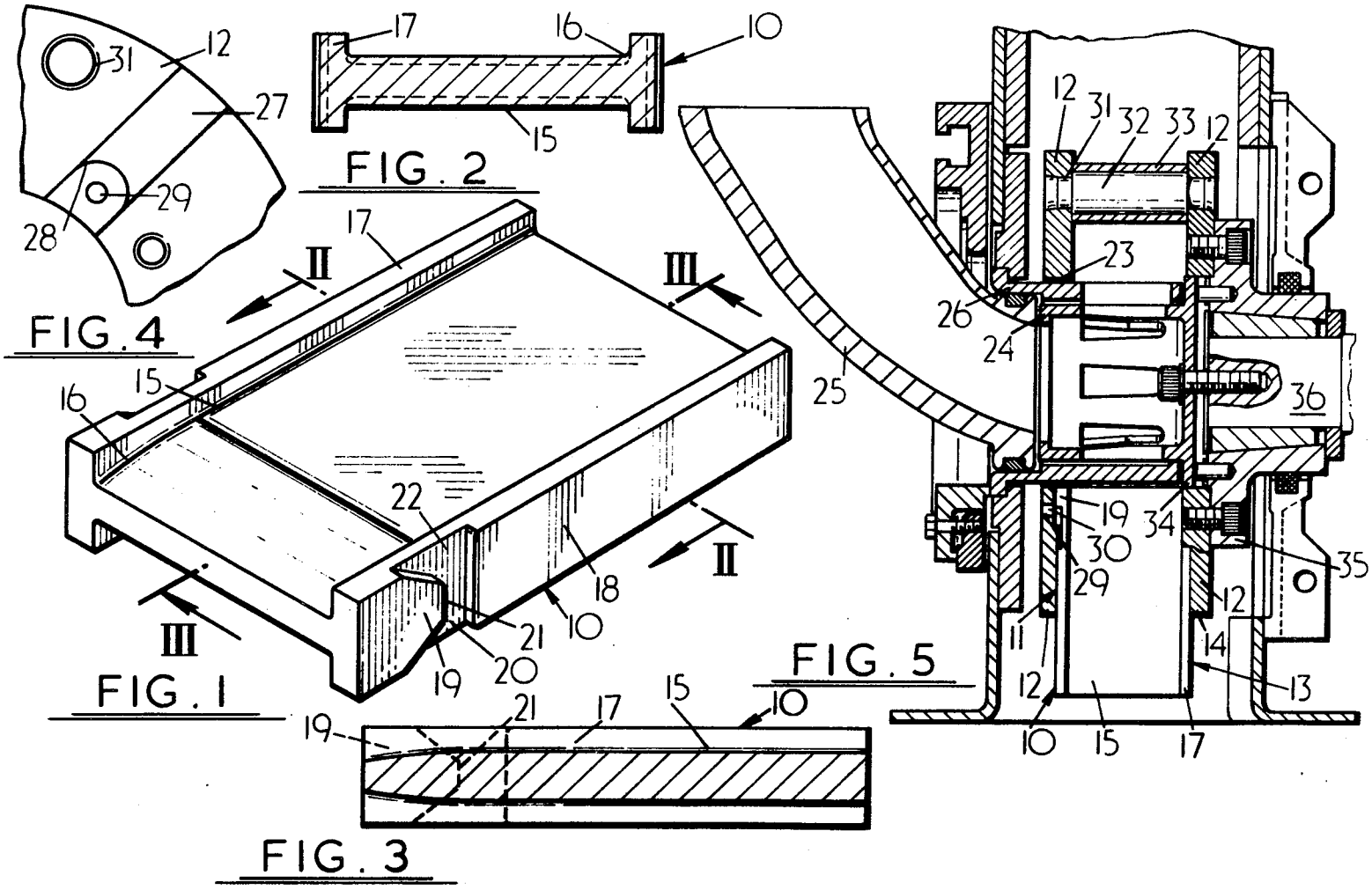
FIG. 1 is a perspective view of a throwing blade according to the invention.
FIG. 2 is a transverse cross-sectional view of the blade on the line II—II in FIG. 1.
FIG. 3 is a longitudinal sectional view of the blade on the line III—III in FIG. 1.
FIG. 4 is a fragmentary view of a side plate of a blast impellor wheel for use in connection with a blade as shown in FIGS. 1 to 3.
FIG. 5 is a cross-sectional view of a blast impellor wheel assembly incorporating a blade and a side plate as shown in FIGS. 1 to 3 and FIG. 4 respectively.
Figure 6:
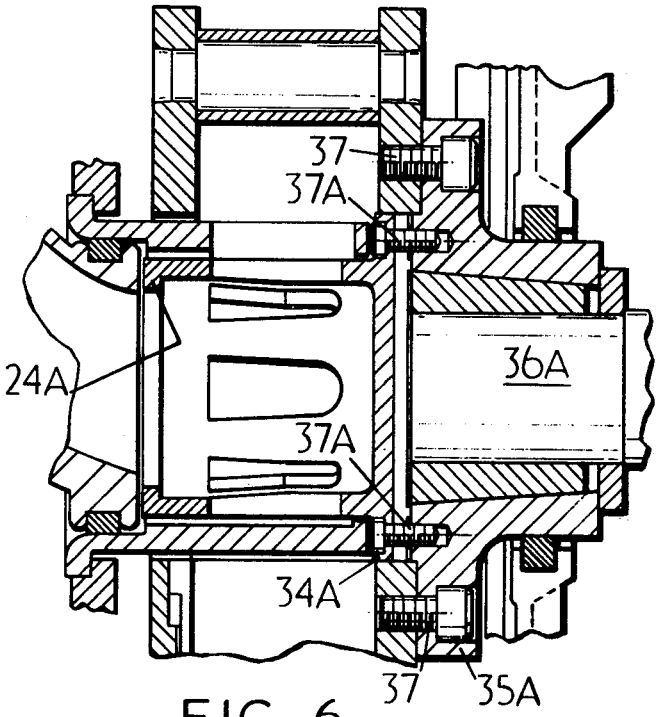
FIG. 6 is a view similar to FIG. 5 but showing an alternative embodiment of part of the blast impellor wheel.

The blade 10 is cast in one piece and is of a substantial rectangular shape with an I-shaped transverse cross-section (FIG. 2). An inner part 11 (FIG. 5) of the blade 10 is intended to be located between the side plates 12 of a blast impellor wheel and an outer part 13 (FIG. 5) of the blade 10 is intended to project beyond the rims 14 of the side plates 12.

The two faces 15 of the blade 10 are identical. At the outer part 13 of the blade the faces 15 are smooth and parallel and at the inner part 11 of the blade 10 the faces 15 curve slightly inwards toward each other. The reason for this curvature is to save wear on the blade 10 by the abrasive as it first strikes the blade 10. The side edges 16 of the faces 15 are radiussed to merge with the flanged sides 17 of the blade 10 to prevent abrasive lodging in the blade 10 itself.

The flanged sides 17 of the blade are also identical. On the outer surface 18 of each of the flanged sides 17, at the blades inner part 11, is a protruberance 19. The end 20 of the protuberance 19 is angled and formed into a blunted nose 21 pointing towards the outer part 13 of the blade 10 and the outer surface 18 of the sides 17 are cut away at 22 so that the nose 21 of the protuberance 19 stands out in relief. Both of these features assist in preventing abrasive lodging between the blade 10 and the side plates 12 of the blast impellor wheel which would make the blade 10 difficult to remove from the wheel.

The blast impellor wheel comprises two side plates 12 between which, say, eight of the blades 10 are located, there being a central opening 23 in the side plates 12 and in which a vane-type impellor 24 with integral centering plate 34 is located and through which the abrasive is fed to the blades 10 from a feed spout 25 and a stationary control cage 26 which has the customary inner return flange omitted and which surrounds the impellor 24 and which is also located in the central opening 23 of the two side plates 12. This construction of integral impellor 24 and centering plate 34 without the customary intervening control cage return flange permits a longer impellor 24 and thus larger slots 27 to be employed so allowing more abrasive to flow through the wheel. The blades 10 are retained in the side plates 12 in eight pairs of equi-angularly-spaced radial slots 27 (FIG. 4) machined in the side plates 12 of the wheel and which extend from the inner diameter of the wheel to the outside diameter or rim.

The inner ends of each of the slots 27 are cut deeper than the rest of the slot 27 so that there is a part-circular ledge 28 against which the nose 21 of a protuberance 19 on a blade 10 will abut. There is clearance between the ledges 28 and the protuberances 19 in the assembled wheel to prevent the abrasive lodging between them and causing wear. In the deeper portions of the slots 27 is a hole 29 through which a nylon stud 30 passes. These studs 30 frictionally retain the blades 10 in position in the slots 27 whilst the wheel is being assembled or another blade 10 is being replaced.

The side plates 12 also have four equi-angularly-spaced pairs of holes 31 and these are used to retain wheel spacers 32, which keep the side plates 12 aligned when they are being rotated. The spacers 32 are covered by a sleeve 33.

The length of the blades 10 and the dimensions of the central opening 23 in the side plates 12 are such that the blades 10 can be fitted into the wheel through the central opening 23. The blades 10 slide into the pairs of slots 27, as described, past the nylon studs 30. The inner parts 11 of the blades 10 abut the integral centering plate 34 of the impellor 24 to prevent the blades 10 from falling out of the side plates 12.

In use, the side plates 12, impellor 24 and integral centering plate 34, and blades 10 are rotated via a wheel hub 35 and a motor shaft 36 to which the wheel hub 35 is rotatably connected. The wheeb hub 35 is bolted to one of the side plates 12 at 37 and the shaft 36 can be bolted directly to the impellor 24 by a bolt coaxial with the shaft 36. Alternatively, the impellor 24A can be bolted to the wheel hub 35A by bolts 37A which pass through the centering plate 34A, which is integral with the impellor 24A. The bolt heads are inset into the centering plate 34A. This latter method of connecting the impellor 24A to the wheel hub 35A for rotation therewith instead of connecting it directly to the shaft 36A substantially mitigates abrasive from clogging the bolt connection. Hence, the impellor wheel is more easily dissembled for repair and replacement of worn parts. Abrasive is fed down the feed spout 25, through the impellor 24 and out, via the control cage 26, onto the faces of the blades 10 to be accelerated and directed onto the article to be blasted. The blades 10 are such that the blast impellor wheel can be used to direct abrasive in each of the two directions of rotation of the wheel, as required, by merely reversing the direction of rotation of the wheel.

When the blast impellor wheel is rotating, the blades 10 are retained in position by the abutment of the protuberances 19 of the blade 10 against the ledges of the slots 27 in the side plates 12, which is brought about by centrifugal force.

This means of retention of the blades 10 in the wheel coupled with the method of fitting the blades through the central opening 23 of the wheel also means that tools are not required in the actual fixing of the blades 10 within the wheel.

What is claimed is:

1. A blade for use in a blast impellor wheel, said blade being rectangular and having an I-configuration in transverse section, opposed ends, a pair of opposed faces each symmetrical about a longitudinal axis for use as an abrasive throwing face, and a pair of longitudinal side flanges, each of said side flanges being cut away adjacent one end of the blade to define in relief a protuberance of substantially triangular shape with a blunt nose pointing towards the other end of the blade such that upon engagement with a retaining ledge of a side plate of a blast impellor wheel, the cut away portion of each flange mitigating abrasive build-up therebetween.

2. The blade as claimed in claim 1, in which the faces of the blade are smooth and parallel, and curve inwards towards each other at said one end of the blade.

3. The blade as claimed in claim 1, in which the faces of the blade are radiussed to merge with the side flanges of the blade.

4. A blast impellor wheel comprising two interconnected parallel side plates each with an inner and outer face and each defining a central opening, the pair of side plates also comprising a plurality of opposed pairs of slots in their inner faces, ledges provided by transverse steps extending across the slots, and at least one rectangular blade, said blade being located between one opposed pair of slots and having an I-configuration in transverse section, opposed ends, and a pair of opposed faces each symmetrical about a longitudinal axis for use as an abrasive throwing face depending on the sense of rotation of the wheel, and a pair of longitudinal side flanges, each flange being cut away adjacent one end of the blade to define in relief a protuberance of substantially triangular shape with a blunt nose pointing towards the other end of the blade and for abutting engagement with one of the transverse ledges across the said one opposed pair of slots.

5. The blast impellor wheel as claimed in claim 4, wherein one of the slots of said one pair of opposed slots defines a hole, and a stud of synthetic material passing through this hole to help frictionally retain the blade between the side plates.

6. The blast impellor wheel as claimed in claim 4, wherein a stationary control cage is housed in the central openings of the side plates, and an impellor with an integral centering plate being coaxial with and located within the control cage.

7. The blast impellor wheel as claimed in claim 4, wherein a hub is connected to one of the side plates, and a motor shaft is connected to the hub to rotate the side plates.

8. The blast impellor wheel as claimed in claim 7, wherein the impellor is rotatably connected directly to the motor shaft.

9. The blast impellor wheel as claimed in claim 7, wherein the impellor is rotatably connected to the hub.

10. The blast impellor wheel as claimed in claim 4, wherein a stationary control cage is housed in the central opening of the side plates, an impellor comprising a cylindrical body defining circumferentially spaced axial slots being coaxial with and located within the control cage, and a centering plate being integral with the impellor at one end to connect the impellor to a drive.

11. The blast impellor wheel as claimed in claim 4, wherein a stationary control cage is housed in the central opening of the side plates and comprises an open-ended cylindrical body defining circumferentially spaced axial slots, and said wheel further includes an outwardly directed flange integral with the control cage to locate the same.

* * * * *